United States Patent [19]

Strange

[11] 4,333,630

[45] Jun. 8, 1982

[54] MOLD BOTTOM AND STOOL PROTECTOR CONSTRUCTION

[76] Inventor: Robert R. Strange, 522 Lynnview Dr., Sagamore Hills, Ohio 44067

[21] Appl. No.: 207,029

[22] Filed: Nov. 14, 1980

[51] Int. Cl.[3] ..... B22D 7/06; B22D 7/12

[52] U.S. Cl. ..... 249/135; 29/402.18; 249/174; 249/204; 249/206

[58] Field of Search ..... 164/271, 92.1, 121; 249/204, 206, 174, 135; 29/402.18; 428/594

[56] References Cited

U.S. PATENT DOCUMENTS

| | | | |
|---|---|---|---|
| 2,391,997 | 1/1946 | Noble | 428/594 X |
| 2,445,801 | 7/1948 | Partiot | 428/594 X |
| 2,907,083 | 10/1959 | Shakely | 249/206 X |
| 3,507,634 | 4/1970 | O'Driscoll | 428/594 X |
| 4,120,345 | 10/1978 | Strange et al. | 249/174 X |

*Primary Examiner*—R. L. Spruill
*Assistant Examiner*—J. Reed Batten, Jr.
*Attorney, Agent, or Firm*—Hamilton, Renner & Kenner

[57] ABSTRACT

A laminated plate assembly (17) for protecting the mold stool (11) or bottom (125) of an ingot mold (10 or 100) during the pouring of molten metal therein, the assembly comprising spaced-apart plates (20, 21 and 22) secured together by embossments (24) or the like.

8 Claims, 6 Drawing Figures

MOLD BOTTOM AND STOOL PROTECTOR CONSTRUCTION

Technical Field

The invention relates generally to the protection of ingot mold stools and closed mold bottoms from erosion due to pouring molten metal into the top of the mold, and more particularly to a plate assembly adapted to be placed over the mold bottom or mold stool which may have an eroded cavity filled with particulate material.

Background Art

In conventional practice steel ingots are cast by pouring molten metal from a ladle into the tops of cast iron molds having open or closed bottoms. Open bottom molds are removably supported vertically on flat mold stools which are separated from the molds when the molds are lifted vertically and stripped from the solidified ingots. Closed bottom molds are normally supported vertically directly on a buggy car and the solidified ingots lifted vertically with the molds remaining on the buggy.

During the casting operation the stream of molten metal forcibly strikes the mold stool or mold bottom due to the ferrostatic head of the metal, and after repeated casts a cavity is eroded in the stool or mold bottom which increases in size with each cast. The molten metal solidifying in this cavity forms a protruding knob on the bottom of the cast ingot, requiring subsequent removal and a substantial reduction in product yield. Moreover, the poured molten metal often enters one side of the cavity and flows rapidly up out of the opposite side striking and scouring or damaging the adjacent mold surface. Hence, the eroded mold stools or closed bottom molds must be frequently replaced or reconditioned.

A proposed method for continuously repairing eroded mold stools and mold bottoms is disclosed in U.S. Pat. No. 4,120,345, and comprises filling the eroded cavity with steel shot and covering the filled cavity with a steel plate prior to the casting operation. It is stated that the molten metal is essentially prevented from entering the eroded cavity and that the particles of shot do not significantly comingle with the molten metal during casting.

In actual practice using this patented method it has been found that in order to prevent the molten metal from contacting the shot in the cavity, the steel plates are required to be so thick and heavy that the plates become quite expensive and difficult to handle and place in position over the cavity. It has also been found that when the poured molten metal strikes the plate the force of the impingement causes the metal to splash outwardly against the sides of the mold, resulting in metal particles or stickers adhering to the mold surfaces and, on solidification, these particles become embedded in the ingot surfaces causing surface defects requiring subsequent removal.

Disclosure of Invention

The present invention utilizes a laminated plate assembly adapted to cover a shot-filled cavity at the bottom of the ingot mold comprising at least two relatively thin spaced-apart pulses so that the molten metal impinging upon the upper plate will penetrate it substantially instantaneously and flow outwardly between the plates, thereby reducing the splashing effect.

It is an object of the present invention to provide an improved laminated plate assembly for protecting a mold stool or mold bottom from erosion by impingement of molten metal, without causing harmful splashing of the molten metal against the mold surfaces.

A more specific object is to provide an improved laminated pulse assembly comprising relatively thin lightweight plates, which is inexpensive and easy to handle.

Another object is to provide an improved laminated plate assembly in which the plate thickness and spacing of the plates is correlated to give optimum results in reducing the splash of the molten metal impinging upon the top plate.

A further object is to provide an optimum composite of different sized shot for filling the eroded cavity of a mold stool or mold bottom covered by the improved laminated plate assembly.

These and other objects are accomplished by the improvements comprising the present invention, a preferred embodiment of which is disclosed herein by way of example as representing the best known mode of carrying out the invention. Various modifications and changes in details of construction are comprehended within the scope of the appended claims.

PREFERRED EMBODIMENTS FOR CARRYING OUT THE INVENTION

Figure 1:
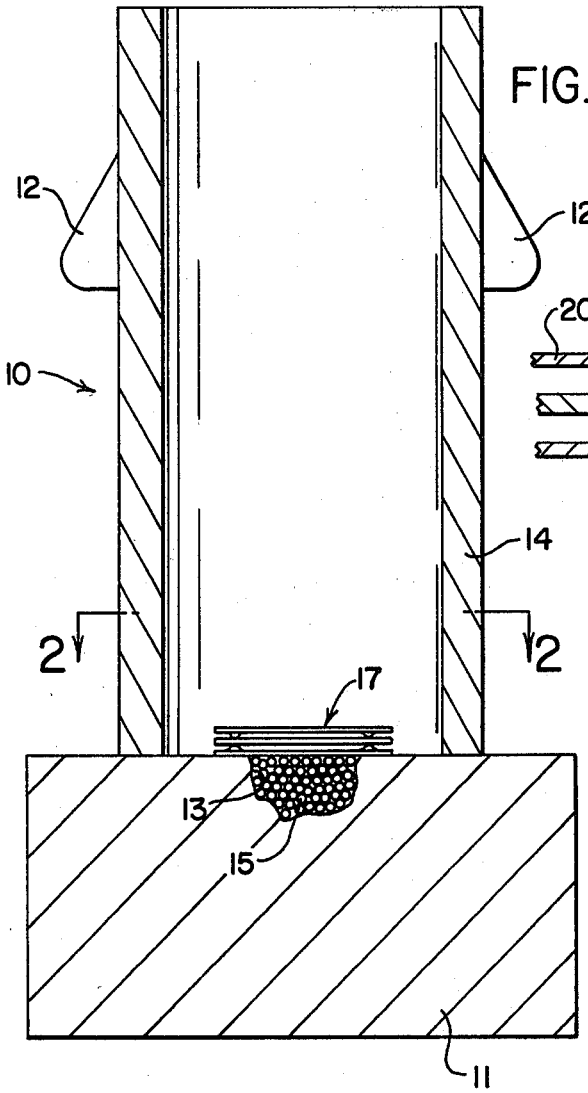
FIG. 1 is a vertical sectional view of an open-ended ingot mold supported on a stool having an eroded cavity filled with shot and a preferred embodiment of the improved laminated plate assembly covering the cavity within the bottom end of the mold.

In FIG. 1 an open-ended ingot mold 10, preferably of cast iron, is supported in vertical position on the flat upper surface of a mold stool 11, also preferably cast iron. The mold 10 may have side lugs 12 thereon to facilitate lifting the mold.

The mold stool 11 is shown as having an eroded cavity 13 in its upper surface within the confines of the side wall 14 of the mold 10, resulting from repeated pourings of molten metal into molds supported on the stool. The cavity is filled with particulate material 15 which may be a composite of steel or iron shot of various sizes, as will hereinafter be specified. The particulate material 15 fills the cavity and restores the substantially flat upper surface of the stool 11.

A laminated plate assembly indicated generally at 17 is superposed over and rests upon the upper surface of the particulate material and the stool 11, and the outer periphery of the assembly is spaced laterally inward of the mold side walls 14. The peripheral dimensions of the plates are correlated to the inside dimensions of the mold; that is, the assembly must be small enough to be easily placed on the stool while completely covering the erosion cavity 13. For example, the assembly may be formed of spaced-apart No. 1008–1015 plain carbon square steel plates with the corners spaced about 2" to 4" inwardly of the sides of a cylindrical mold.

The thicknesses of the individual plates as well as the aggregate thickness and the spacing between the plates is quite critical in order to allow the molten metal poured into the top of the mold to penetrate the top plate substantially instantaneously and flow outwardly between the plates, thus minimizing the splash of the molten metal against the inner surfaces of the mold walls 14, while protecting the top of the stool and the particulate material from contact with the molten metal. Actual tests have shown that the thicknesses of the individual plates may vary between about 0.070" to 0.250" and the aggregate thickness should be at least 0.256". The spacing between the plates must be not less than 0.0625" and not more than 0.50".

Figure 4:
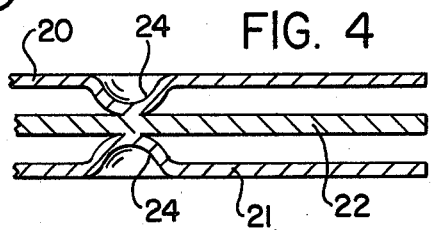
FIG. 4 is an enlarged fragmentary sectional view on line 4—4 of FIG. 3.
Figure 2:
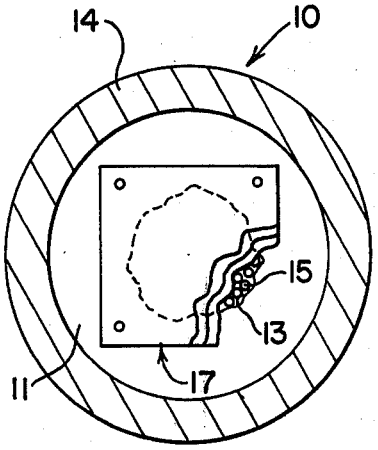
FIG. 2 is a plan sectional view on line 2—2 of FIG. 1.
Figure 3:
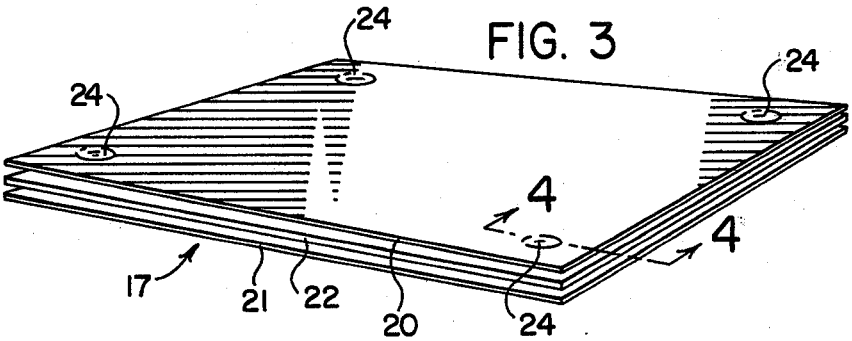
FIG. 3 is a perspective view of the improved laminated plate assembly.

Referring to FIGS. 3 and 4, a preferred arrangement giving optimum results is a three-plate assembly wherein the upper plate 20 and the lower plate 21 are each 0.078" thick and the middle plate 22 is 0.100" thick, with the spacing between the plates being 0.1875". Preferably, the plates are secured together in spaced-apart relation by laterally spaced embossments 24 in the upper and lower plates 20 and 21, the tips of the embossments being welded to the middle plate 22.

It is to be understood that the number of spaced plates may be varied from two to three or more so long as the foregoing limits as to individual and aggregate thicknesses, as well as spacing, are maintained.

Figure 5:
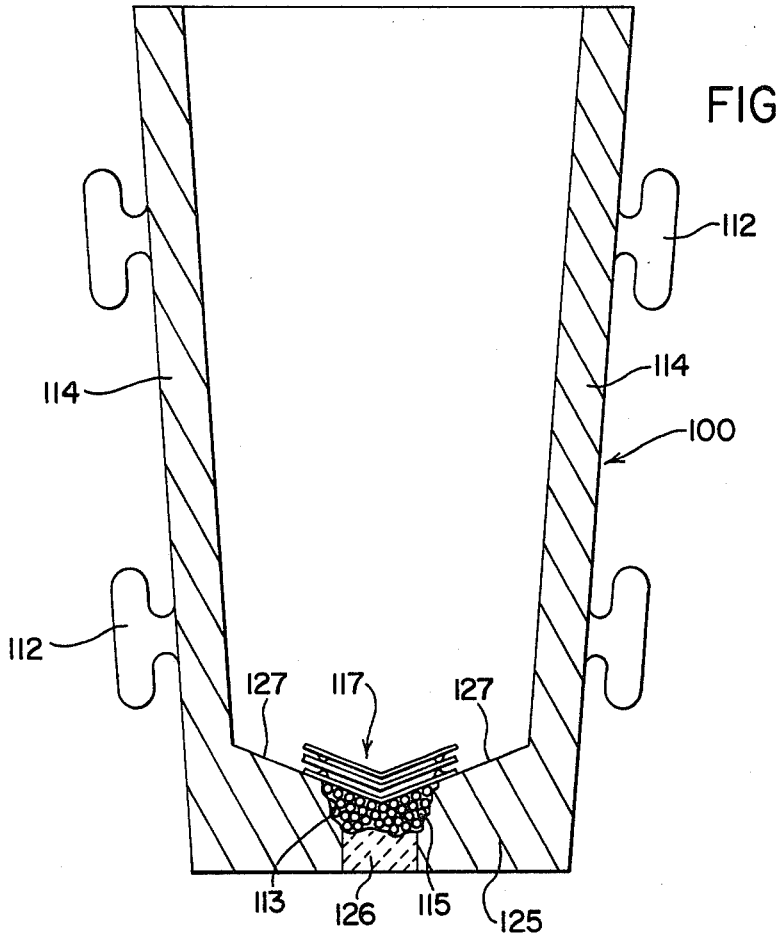
FIG. 5 is a vertical sectional view of a big-end-up closed bottom ingot mold having a modified embodiment of the improved laminated plate covering a shot-filled cavity in the bottom of the mold.
Figure 6:
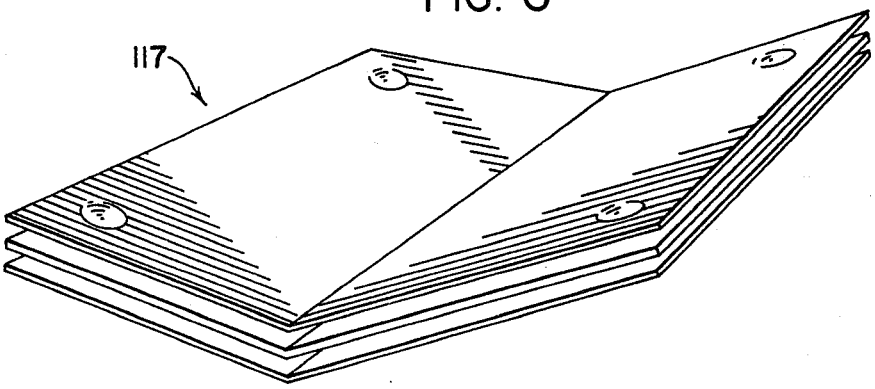
FIG. 6 is a perspective view of the laminated plate assembly shown in FIG. 5.

In the embodiment of FIGS. 5 and 6, a closed-bottom, big-end-up or tapered mold 100 is shown having side walls 114 with lifting lugs 112 thereon. The bottom wall 125 has an eroded cavity 113 therein filled with shot 115, and a refractory plug 126 may have been inserted below the cavity 113 to close the bottom wall.

As shown, the upper surfaces 127 of the bottom wall may be inclined to form a V-shape, and the plate assembly 117 may be formed in a V-shape to conform to the mold bottom surfaces 127. Otherwise the rectangular plates of the assembly 117 are substantially the same as the plates 20, 21 and 22 of assembly 17 in respect to thickness and spacing.

In the normal casting operation in molds such as 10 or 100, molten metal is poured from a ladle into the top of the mold and the stream of molten metal strikes the upper surface of the mold stool or mold bottom with great force due to its ferrostatic head. Repeated pourings result in the erosion cavity 13 in the mold stool or 113 in the bottom wall of the mold.

According to the present invention the erosion cavity 13 or 113 is filled with particulate material level with the upper surface of the stool or mold bottom. Preferably, the particulate material is steel or iron shot which may have the following typical analysis:

Steel—0.9% carbon, 0.9% silicon, 0.75% manganese, and balance iron.

Iron—2.0%–3.0% carbon, 0.5% silicon, 0.5% manganese and balance iron.

It has been discovered that if the shot is a composite of different sizes distributed according to certain percentage ranges, the shot will sinter together during the casting operation to such an extent that very little of the shot will adhere to the casting and be pulled from the eroded cavity in the mold stool or bottom when the solidified casting is lifted therefrom. The following size distribution has been found to give satisfactory results:

| U.S. Standard Screen Opening | Screen No. | Percentage Range | Optimum Percentage |
|---|---|---|---|
| .0165" | 40 | 0–10 | about 5 |
| .0394" | 18 | 15–25 | about 20 |
| .0787" | 10 | 45–55 | 50 |
| .1320" | 6 | 20–30 | 25 |

After the shot composite has been inserted in the erosion cavity of the mold stool or mold bottom, the upper surface of the shot and surrounding stool or mold bottom surface is coated with a sealant comprising a silicious or graphitic water solution. This sealant protects the erosion cavity from moisture when exposed to weather conditions during disuse, and also serves as a release agent when separating the solidified casting from the mold.

Following the application of the sealant coating the steel plate assembly is placed over the erosion cavity in position to be within the side walls of the mold and the molten metal is then poured into the top of the mold. As the first metal strikes the top plate it immediately penetrates and melts the relatively thin top plate and flows laterally outward between the plates, thus minimizing the amount of splash and the resulting stickers on the adjacent mold surfaces which would cause defects on the surface of the solidified casting. The entrapped air between the plates acts as a cushion retarding the lateral flow of the molten metal. The spacing between the plates of not less than 0.0625" and not more than 0.50" insures complete filling of the interstices in the molten metal during pouring prior to initial solidification. The multiple plate construction of the plate assembly protects the shot in the cavity from contact with the molten metal, thereby minimizing the amount of shot adhering to the solidified casting when the mold is stripped therefrom.

Although the improved laminated plate assembly has been shown and described as used to cover over an eroded cavity in a mold stool or mold bottom to repair the upper surface thereof, it will be apparent that the improved laminated plate assembly is also adapted to be used on uneroded mold stools and mold bottoms to protect them from erosion by poured molten metal.

I claim:

1. In combination, an ingot mold including a bottom having an ingot molding surface and including an eroded cavity defined therein and filled with particulate material, and a laminated plate assembly covering said filled cavity and comprising at least two spaced-apart metal plates secured together at laterally spaced points, the thickness of each plate being between about 0.070 and 0.250 inches, and the spacing between the plates being between 0.0625 and 0.50 inches, the spaced-apart metal plates being substantially parallel to one another and substantially parallel to the ingot molding surface.

2. The combination of claim 1, wherein the laminated plate assembly has three spaced-apart plates, the thickness of each being between about 0.070 and 0.250 inches with an aggregate thickness of at least 0.256 inch, and the spacing between the plates being between 0.0625 and 0.50 inches.

3. The combination of claim 1, wherein the particulate material is a composite of steel shot varying in screen mesh sizes from No. 6 to No. 40.

4. In combination, an ingot mold including a bottom having an ingot molding surface and including an eroded cavity defined therein and filled with a composite of steel shot varying in screen mesh sizes from No. 6 to No. 40, and a laminated steel plate assembly covering said cavity and comprising three plates spaced apart about 0.1875 inch, the upper and lower plates being about 0.078 inch in thickness and the middle plate about 0.100 inch in thickness, the spaced-apart plates being substantially parallel to one another and substantially parallel to the ingot molding surface.

5. The combination of claim 4, wherein the composite of steel shot comprises 0–10% of screen mesh size No. 40, 15–25% of No. 18, 45–55% of No. 10, and 20–30% of No. 6.

6. The combination of claim 4, wherein the composite of steel shot comprises the approximate optimum percentages of about 5% of screen mesh size No. 40, about 20% of No. 18, 50% of No. 10, and 25% of No. 6.

7. In combination, an ingot mold including a bottom having an ingot molding surface, and a laminated plate assembly covering said mold bottom and comprising at least two spaced-apart metal plates secured together at laterally spaced points, the thickness of each plate being between about 0.070 and 0.250 inches, and the spacing between the plates being between about 0.0625 and 0.50 inches, the spaced-apart metal plates being substantially parallel to one another and substantially parallel to the ingot molding surface.

8. The combination of claim 7, wherein the laminated plate assembly has three spaced-apart plates, the thickness of each being between about 0.070 and 0.250 inches with an aggregate thickness of at least 0.256 inch, and the spacing between the plates being between about 0.0625 and 0.50 inches.

* * * * *

UNITED STATES PATENT AND TRADEMARK OFFICE

CERTIFICATE OF CORRECTION

PATENT NO. : 4,333,630

DATED : June 8, 1982

INVENTOR(S) : ROBERT R. STRANGE

It is certified that error appears in the above-identified patent and that said Letters Patent are hereby corrected as shown below:

Column 1, line 67, "pulses" should read --plates--.

Column 2, line 9, "pulse" should read --plate--.

Signed and Sealed this

*First* Day of *March 1983*

[SEAL]

*Attest:*

GERALD J. MOSSINGHOFF

*Attesting Officer*

*Commissioner of Patents and Trademarks*